US007849607B2

(12) United States Patent
Alvarez

(10) Patent No.: US 7,849,607 B2
(45) Date of Patent: Dec. 14, 2010

(54) ADJUSTABLE MEASURING GAUGE

(75) Inventor: Peter H. Alvarez, Leonardo, NJ (US)

(73) Assignee: Tru-Reveal LLC, Port Monmouth, NJ (US)

( * ) Notice: Subject to any disclaimer, the term of this patent is extended or adjusted under 35 U.S.C. 154(b) by 58 days.

(21) Appl. No.: 12/380,766

(22) Filed: Mar. 3, 2009

(65) Prior Publication Data

US 2009/0229139 A1 Sep. 17, 2009

Related U.S. Application Data

(60) Provisional application No. 61/068,917, filed on Mar. 11, 2008.

(51) Int. Cl.
*E04F 21/00* (2006.01)
*G01B 5/14* (2006.01)

(52) U.S. Cl. ..... 33/567.1; 33/194

(58) Field of Classification Search ..... 33/567.1, 33/194, 427

See application file for complete search history.

(56) References Cited

U.S. PATENT DOCUMENTS

| | | | | | |
|---|---|---|---|---|---|
| 1,779,812 | A * | 10/1930 | Hastings | 33/562 |
| 2,265,234 | A * | 12/1941 | Jensen | 271/255 |
| 2,473,639 | A * | 6/1949 | Erickson | 33/42 |
| 3,738,010 | A * | 6/1973 | Carder | 33/489 |
| 4,485,558 | A * | 12/1984 | Lycan et al. | 33/833 |
| 5,123,172 | A | 6/1992 | Thrun | |
| 5,566,460 | A * | 10/1996 | Bates | 33/296 |
| 5,737,844 | A | 4/1998 | Brumley | |
| 5,775,036 | A | 7/1998 | Stanley, Sr. | |
| 6,195,904 | B1 | 3/2001 | Greer | |
| 6,513,258 | B1 | 2/2003 | Casner | |
| 7,240,435 | B1 | 7/2007 | Dowdakin | |
| 7,509,746 | B1 * | 3/2009 | Kozina et al. | 33/194 |
| 7,644,502 | B2 * | 1/2010 | Arne | 33/194 |
| 2003/0131486 | A1 * | 7/2003 | Wallace | 33/194 |

* cited by examiner

*Primary Examiner*—Christopher W Fulton
(74) *Attorney, Agent, or Firm*—Lerner, David, Littenberg, Krumholz & Mentlik, LLP

(57) ABSTRACT

An adjustable measuring gauge has at least two sized and shaped operatively associated members made of a durable material. The lower member has an upper side and a first elongated and square side edge with a plurality of measurements beginning at zero marked at the upper surface. At least one upper member is slidably and adjustably connected to the lower member and has a second elongated square side edge disposed in assembled position on adjustable movement of the upper and lower member to uncover and reveal the desired measurement marked on the lower member. Elongated aligned slots and threaded pegs are provided to achieve unidirectional movement for an accurate measurement. A clamping assembly is provided to both hold the operative associated members so the adjustable measuring gauge can be reused for another measurement; further, a non-skid fabric on at least the upper member to facilitate use and handling.

2 Claims, 4 Drawing Sheets

ADJUSTABLE MEASURING GAUGE

This application claims the benefit of the filing date of U.S. Provisional Patent Application No. 61/068,917 filed Mar. 11, 2008, the disclosure of which is hereby incorporated herein by reference.

This invention relates generally to measuring devices used in the construction of buildings and in the fabrication of large and small products and for use with devices of various types and kinds, and more particularly to an adjustable measuring gauge for such construction, fabrication and other uses, for example, in the construction work, accurate measurements for reveals and setbacks and in other uses as a depth gauge for saws and routers and for marking parallel lines for rip saw cutting.

BACKGROUND OF THE INVENTION

Adjustable measuring tapes for all types of work are well known in the art and have been assembled and used in various types of dispensing and recovery devices. However, where accurate measurements are needed, such tapes fail to achieve and keep the accuracy desired.

In particular, in carpentry work where accurate measurements for a reveal or setback are needed, these tapes and other forms of jury-rigged measuring devices fail to provide the desired accuracy needed. Further, many of these measuring devices cannot be reused.

The carpentry aspect regarding measuring and marking a reveal for the installation of casing trim about windows, doors, medicine cabinets and the like, and an adjustable and reusable measuring device for establishing reveals and setbacks, is described in detail in U.S. Pat. No. 7,240,435B1 citing prior art U.S. Pat. Nos. 6,513,258; 5,737,844 and 5,123,172. Other similar prior art are U.S. Pat. Nos. 6,195,904B1 and 5,775,036.

These prior art approaches indicate that an improved adjustable and reusable measuring gauge is always needed for establishing accurate measuring and marking.

SUMMARY AND OBJECTS OF THE INVENTION

Thus, an adjustable measuring gauge in accordance with the present invention consists of at least two operatively associated members or blocks made of a durable material, such as a light metal like aluminum, or other light metal materials, hardwood, or durable plastics which are mounted on each other for slidable and operative association to establish a fixed measurement which can be used to mark a line and/or depth or a predetermined space, such as a reveal or a setback and then reused for other and further measurements.

The bottom member has two elongated slotted grooves and two threaded holes centered between the respective ends of the slotted grooves. The sized and shaped upper member is slidably and adjustably connected to the lower or bottom member. Thus, the upper member has one elongated slotted groove and two threaded holes or bores, each respective bore or hole located on opposite sides and near one end of the elongated slotted groove. The respective lower or bottom member and upper or top member has threaded pegs in the respective threaded bore or hole which allows the two plates to slide in unidirectional movement relative to each other.

A sized and shaped lower member has an upper side and a lower side and at least one elongated and square side edge with a plurality of measurements beginning at zero marked on the upper face or side of the lower member adjacent to the square side edge. The upper member has a second elongated square side edge disposed in assembled position so that by adjustable movement on the repositioning of the upper member relative the lower member will reveal the desired one of the plurality of measurement markers at the square side edge on the upper side or face of the lower member.

A clamping assembly is provided to both hold and release the operatively associated upper and lower members in this slidable and adjustable assembly and to lock and release the operatively associated upper member and lower member, so that at any adjusted position the adjustable measuring gauge can be used for the given measurement and then reused for another measurement.

The clamping assembly includes a locking lever which has a rounded section at one end, having a slotted groove in which one end of an elongated rod, threaded at the end remote from the rounded section, is mounted. The threaded rod extends through the end of the elongated slot in the upper or top member for threaded engagement with the remaining threaded hole in the lower or bottom member. Locking engagement and disengagement is obtained by rotating and turning the locking lever into the locked and unlocked engagement positions. Washers hard and soft of various types are provided to aid the action of the locking lever.

Further, the respective top side of the upper member and the bottom side of the lower member have shaped fabric or the like material affixed thereon to prevent slippage and facilitate establishing the desired measurement during use and reuse of the disclosed adjustable measuring gauge.

Accordingly, it is one aspect of the present invention to provide an adjustable and reusable measuring gauge which can also be used for marking accurate guidelines and depths where needed in carpentry, fabrication and other types of uses such as for sawing or routing actions.

It is another aspect of the present disclosure to provide an adjustable measuring gauge in which accurate adjustment is obtained by slotted grooves and peg members which assure unidirectional movement of the interengaging measuring members.

It is still another aspect of the present disclosure to provide non-skid materials on the operative surfaces of the disclosed adjustable measuring gauge to facilitate use and reuse and to assist in obtaining an accurate setting for the disclosed adjustable measuring gauge.

Other aspects, objectives and advantages of the disclosed subject matter will become more apparent from the description thereof which follows below, when taken and reviewed in conjunction with the accompanying drawings.

DESCRIPTION OF A PREFERRED EMBODIMENT OF THE INVENTION

Figure 1:
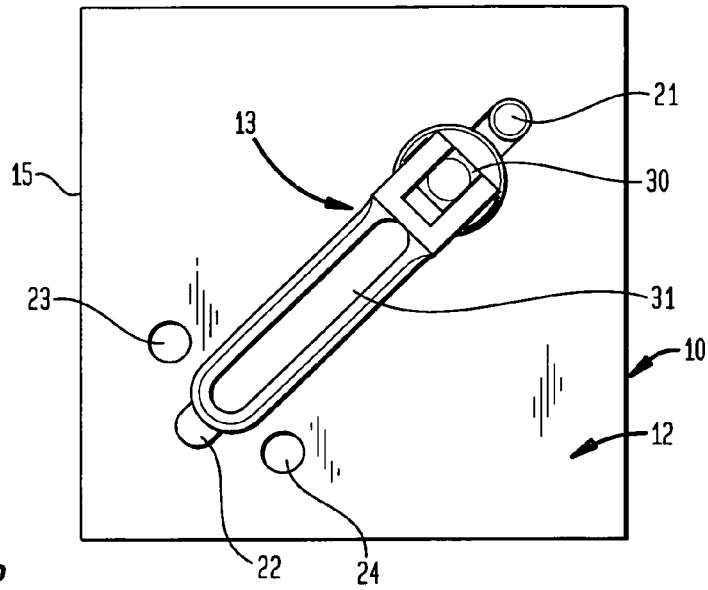
FIG. 1 is a top plan view of the adjustable measuring gauge in accordance with the present invention.
Figure 2:
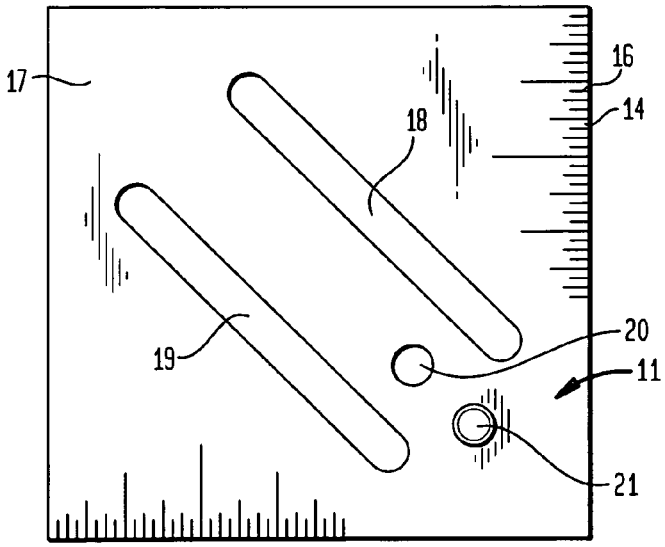
FIG. 2 is a top plan view of the lower member of the adjustable measuring gauge shown in FIG. 1.
Figure 3:
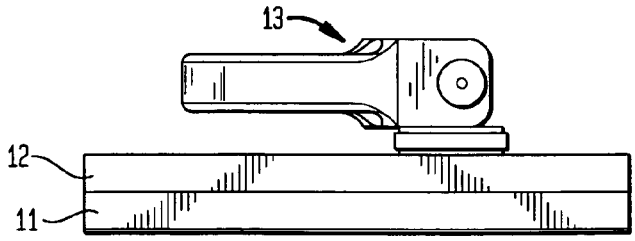
FIG. 3 is a side view of the adjustable measuring gauge shown in FIG. 1.

FIGS. 1, 2 and 3 of the drawings show an adjustable measuring gauge generally designated 10 in accordance with the present invention having a lower member or block 11, an upper member or block 12, and a clamping assembly generally designated 13. These elements of the gauge 10 can be made of a light and durable metal such as aluminum, a hardwood material such as ash or a durable plastic so they will remain usable for long periods of time under the general conditions and handling during carpentry, fabrication work or other types of uses.

Figure 6:
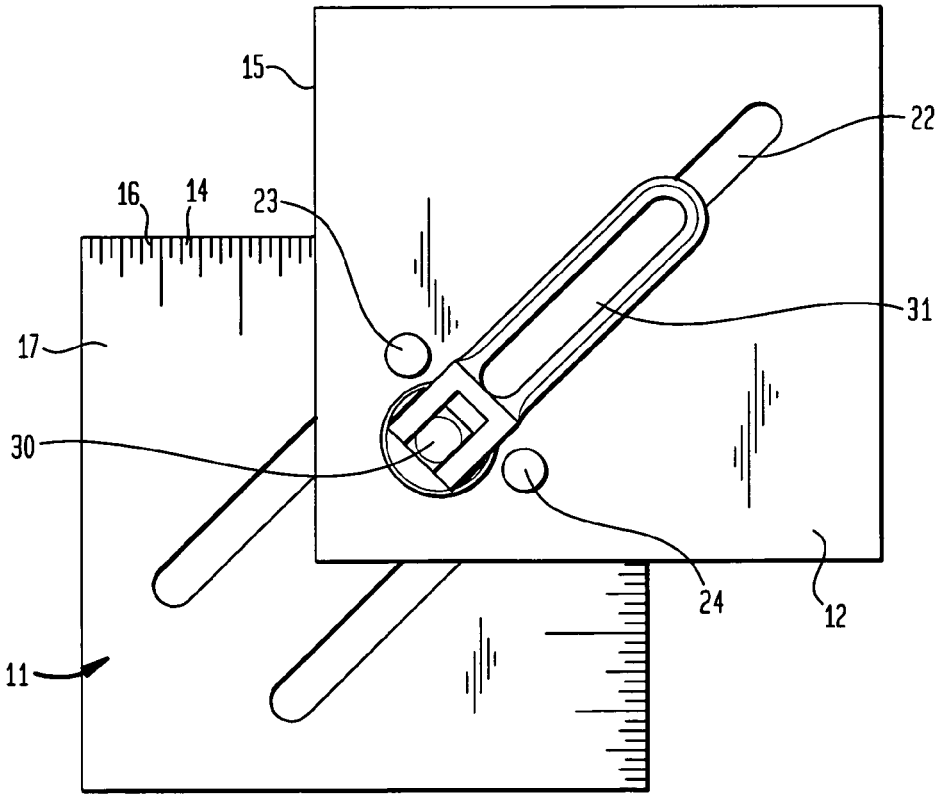
FIG. 6 is a top plan view of the adjustable measuring gauge shown in FIG. 1 in an adjusted and locked and engaged measuring position.

The lower member and upper member are sized and shaped generally in square form so as to provide at least one first elongated and square side as at 14 on the lower member 11 and at least one second elongated and square side 15 on the upper member 12 so disposed in assembled position that the second elongated and square side member will at all times lie and, when the members 11 and 12 are adjusted, move so that the second elongated and square side 15 is perpendicular to the first elongated and square side 14. The reason for this arrangement will be clear from the measurement markings as at 16 shown on the upper face or surface 17 of the lower member 11 at FIGS. 2 and 6 of the drawings. The measurement markings can be in inches or metric, and at least a second elongated square side on the upper member is disposed perpendicularly to said second elongated square side of the lower member to accommodate the respective type of measurement markings.

Those skilled in the art will recognize that there are other sizes and shapes that can be used, provided that they have the interacting respective elongated square sides as above described, without departing from the scope of the present disclosure. Additionally, the size of the respective upper and lower member will determine the extent or size of the measurements that can be made with the adjustable measuring gauge 10.

Lower member 11 and upper member 12 are so designed that when they are moved to an adjusted position as hereinafter described, they will provide an accurate measurement for the desired use. Thus, lower member or plate 11 has a first set of generally parallel slots or grooves as at 18 and 19, and two threaded holes as at 20 and 21 which lie in a line generally parallel to the slots 18 and 19. The upper member 12 has a third slot or groove 22 and a pair of holes as at 23 and 24 disposed respectively on opposite sides of the third slot or groove 22 and in alignment with each other, all of which is shown in FIGS. 1, 2, 3 and 4 of the drawings.

Figure 4:
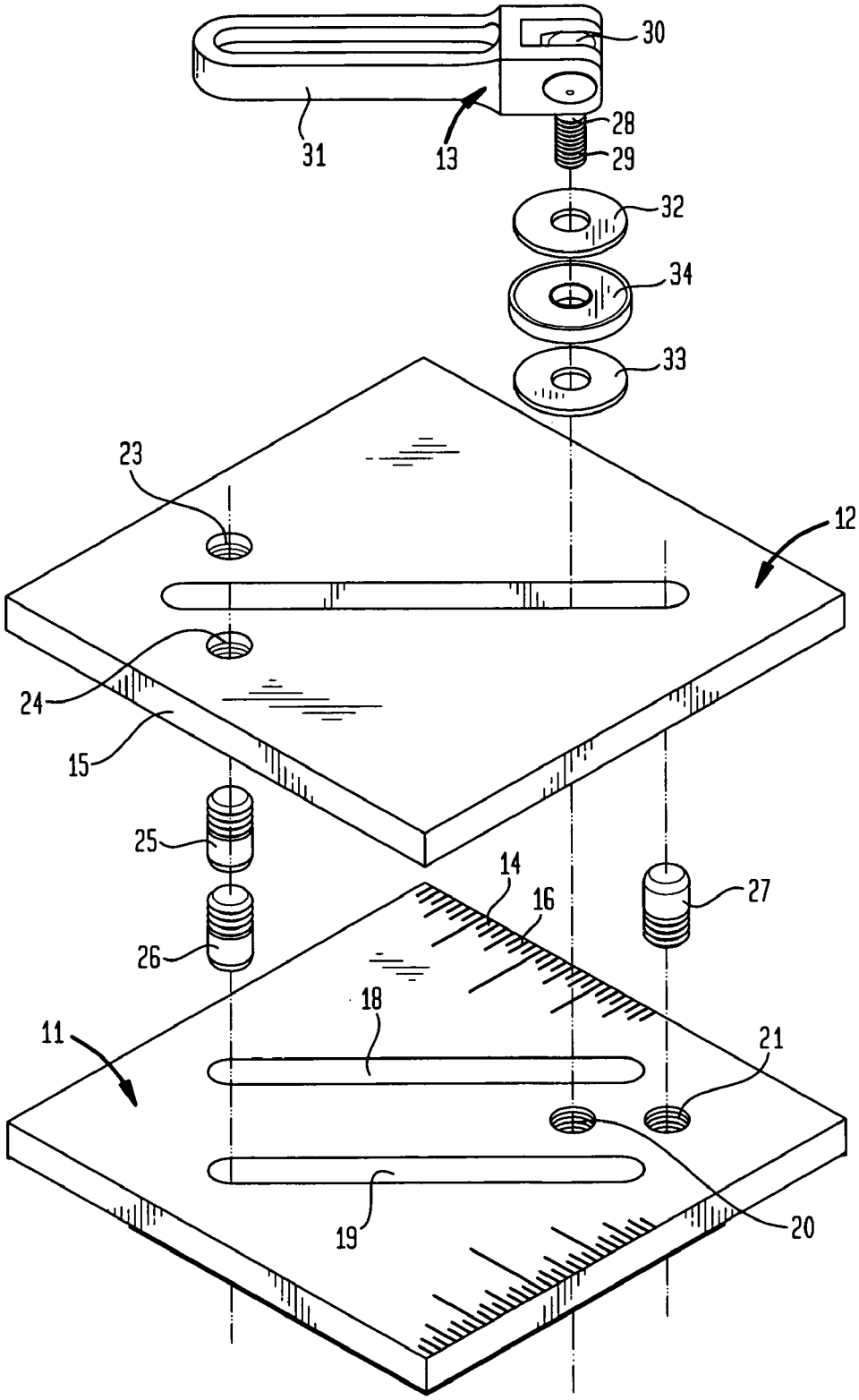
FIG. 4 is an exploded view of the adjustable measuring gauge shown in FIG. 1.
Figure 5:
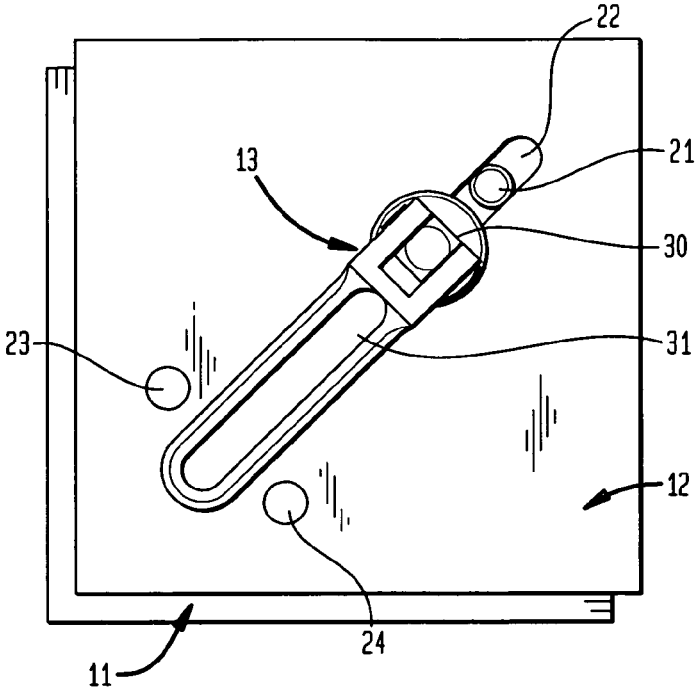
FIG. 5 is a top plan view of the adjustable measuring gauge shown in FIG. 1 in an inoperative or non-engaged measurement position.

FIG. 4 shows that threaded pegs or posts as at 25 and 26 threadably mounted in the threaded holes 23 and 24 in the upper member 12 are disposed for adjustable sliding engagement with the respective first set of slots and grooves 18 and 19 in the lower member 11, and the threaded peg or post 27 threadably mounted on the threaded hole 21 in the lower member is disposed for adjustable sliding engagement with the third slot or groove 22 in the upper member 12 so that the lower member 11 and upper member 12 can be adjusted relative to each other to a position as a function of the desired measurement to be established with reference to the measurement markings either in inches or in metric amounts.

FIG. 4 further shows that the lower member, block or plate 11 and the upper member, block or plate 12 are held together and can be locked and released from a desired measurement by the clamping assembly 13. Clamping assembly 13 has a central post or member 28 which is threaded at one end as at 29 so that the central post or member 28 can extend through the slot or groove 22 in the upper member 12 into engagement with the threaded hole 20 in the lower member 11 to hold the lower member, the upper member and the clamping assembly 13 together for operative relation. The end of the central post or member 28 remote from the threaded end has a caming member 30 on which is mounted for pivotal movement lever arm 31. Further, disposed between the lower face of the caming member 30 is a first and second washer as at 32 and 33 with a rubber gasket 34 therebetween. Thus, by pivoting the lever arm 31 down, the respective lower plate 11 and upper plate 12 can be tightened to lock them into any given adjusted position. By pivoting the lever arm 31 up, the respective lower member 11 and upper member 12 will be released and free to slide relative to each other and be set at another desired measurement.

In use, the lever arm 31 is moved to the released or non-locking position to release the respective lower member or plate 11 and upper member or plate 12 so that the upper member or plate 12 can be moved and adjusted relative the lower member or plate 11 until the desired measurement marking is uncovered by the elongated square side edge 15 of the upper member. The lever arm 15 is then pivoted for locking the upper member or plate 12 in place. The adjustable measuring gauge can then be applied by moving the gauge so that an accurate line can be scribed or the location or device where the accurate measurement is needed.

Figure 7:
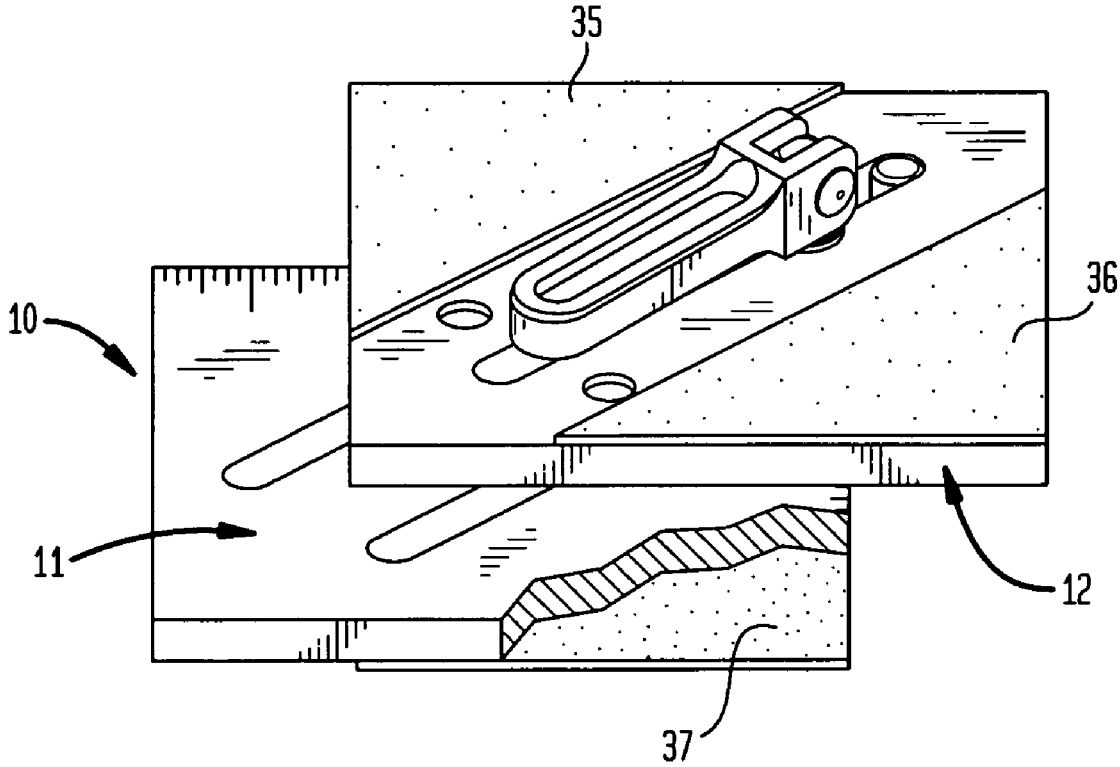
FIG. 7 is a top perspective view of the adjustable measuring gauge shown in FIG. 1 in the open position showing non-skid fabric on the respective top side or face of the upper member and broken away to show the non-skid fabric on the bottom side of the lower member.

FIG. 7 further shows that the top side or face of the upper member can be provided with a non-skid fabric material which is shown in triangular shaped patches as at 35 and 36 to facilitate handling and adjustment of the adjustable measuring gauge 10. FIG. 7 also shows that the same type of non-skid fabric or the like material can also be placed on the bottom side or face of the lower member 11, as at 37.

Thus, a relatively durable and simple adjustable measuring gauge is provided to get a constant and accurate measurement which is adapted for use by experienced and inexperienced artisans.

Although the invention herein has been described with reference to embodiments particularly adapted for use in establishing reveals and setbacks in construction work, it is to be understood that these embodiments are merely illustrative of the principles and applications of the present invention and that the present invention has other and use and additional applications for example in fabrication work, sawing and routing. It is therefore to be understood that numerous modifications may be made to the illustrative embodiments and that other arrangements may be devised without departing from the spirit and scope of the present invention as defined by the appended claims.

The invention claimed is:

1. An adjustable measuring gauge to provide uniform and accurate measurements for various uses comprising:

a. a sized and shaped lower member having an upper face and a lower face, at least one elongated square side edge with measurement markings beginning at zero on said upper face adjacent to the elongated square side edge, b. at least one second sized and shaped upper member having a second elongated square side edge, c. a plurality of aligned longitudinal slots on the lower member, d. aligned threaded posts in said upper member disposed for sliding engagement with said plurality of longitudinal slots, e. at least one third slot in said upper member and at least one third threaded post in said lower member disposed for sliding engagement with the third slot in said upper member, f. said respective posts and slots operatively disposed to enable the upper member to be adjusted relative the lower member to provide a generally slidable and adjustable assembly for unidirectional movement of said upper member relative said lower member, whereby the elongated square side edge of the said upper member will move across and expose the desired measurement on the lower member, and g. clamping assembly means for holding the lower and said upper member together and for holding and releasing the said upper member relative the lower member to allow for reuse of the adjustable measuring gauge.

2. The adjustable measuring gauge as in claim or 1 wherein the clamping assembly comprises:

a. a central post threaded at one end to enable the clamping assembly to be connected to said lower member to hold the lower member, the upper member and the clamping assembly together, b. a caming member at the end of the clamping assembly adjacent to the central post, and c. a lever arm connected to said caming member and said lever arm pivotal from a locking position at a desired measurement to a release position to enable the adjustable measuring gauge to be reset to another measurement.

* * * * *

UNITED STATES PATENT AND TRADEMARK OFFICE

CERTIFICATE OF CORRECTION

PATENT NO. : 7,849,607 B2
APPLICATION NO. : 12/380766
DATED : December 14, 2010
INVENTOR(S) : Peter H. Alvarez It is certified that error appears in the above-identified patent and that said Letters Patent is hereby corrected as shown below:

At column 6, line 1, after "claim" delete "or".

Signed and Sealed this
Fourteenth Day of February, 2012

David J. Kappos

David J. Kappos
*Director of the United States Patent and Trademark Office*